US010208723B2

(12) United States Patent
Carey

(10) Patent No.: US 10,208,723 B2
(45) Date of Patent: Feb. 19, 2019

(54) THREADED FUEL RAILS

(71) Applicant: Hi-Vol Products, Livonia, MI (US)

(72) Inventor: Paul G. Carey, Plymouth, MI (US)

(73) Assignee: HI-VOL PRODUCTS, Livonia, MI (US)

( * ) Notice: Subject to any disclaimer, the term of this patent is extended or adjusted under 35 U.S.C. 154(b) by 0 days.

(21) Appl. No.: 15/163,884

(22) Filed: May 25, 2016

(65) Prior Publication Data

US 2017/0342950 A1 Nov. 30, 2017

(51) Int. Cl.
*F02M 55/02* (2006.01)
*F02M 63/02* (2006.01)

(52) U.S. Cl.
CPC ..... *F02M 55/025* (2013.01); *F02M 63/0275* (2013.01)

(58) Field of Classification Search
CPC ..... F02M 55/004; F02M 55/025; F02M 63/0225; F02M 55/005; F02M 61/14; F02M 2200/8076; F02M 2200/856
See application file for complete search history.

(56) References Cited

U.S. PATENT DOCUMENTS 6,668,803 B1 * 12/2003 McClean ..... F02M 61/14 123/456
7,438,055 B1 * 10/2008 Xu ..... F02M 61/14 123/456
8,074,624 B2 * 12/2011 Hohkita ..... F02M 55/025 123/456
8,596,246 B2 12/2013 Nishizawa et al.
8,844,500 B2 9/2014 Bedekar et al.
8,844,502 B2 9/2014 Solferino et al.
9,157,401 B2 * 10/2015 Stieler ..... F02M 55/004
2007/0069043 A1 * 3/2007 Bogner ..... F02M 51/0603 239/102.2
2009/0178650 A1 * 7/2009 Zdroik ..... F02M 61/14 123/470
2011/0108005 A1 * 5/2011 Nishizawa ..... F02M 55/025 123/469
2011/0232609 A1 * 9/2011 Roseborsky ..... F02M 61/14 123/470
2012/0031997 A1 * 2/2012 Harvey ..... F02M 55/005 239/289

(Continued)

FOREIGN PATENT DOCUMENTS

CN 101852154 A 10/2010
CN 203285591 U 11/2013

(Continued)

*Primary Examiner* — Sizo Vilakazi
(74) *Attorney, Agent, or Firm* — Brooks Kushman P.C.

(57) ABSTRACT

A fuel rail assembly for gasoline direct injection fuel delivery to an engine. The assembly has a common rail tube. In the tube there are threaded orifices extending laterally. Injector sockets are adapted to mate with the threaded orifices. Each injector socket has a proximal nipple end region connected to the tube and a distal end region through which fuel is delivered to the engine. Screw threads are disposed around the proximal nipple end region. The screw threads include a lead thread that is received by the threaded orifices, thereby forming mechanical connections between the injector sockets and the tube that are adapted to withstand maximum pressures of fuel up to 5000 psi.

6 Claims, 2 Drawing Sheets

(56) References Cited

U.S. PATENT DOCUMENTS

2012/0210980 A1* 8/2012 Bedekar ..... F02M 55/004
123/456

FOREIGN PATENT DOCUMENTS

| | | | |
|---|---|---|---|
| CN | 203348061 | U | 12/2013 |
| DE | 102013220788 | | 11/2014 |
| EP | 1378658 | | 1/2004 |
| EP | 2284385 | A1 | 2/2011 |
| EP | 2333302 | A1 | 6/2011 |
| JP | 2003129920 | A | 5/2003 |
| JP | 200569023 | | 11/2005 |

* cited by examiner

THREADED FUEL RAILS

TECHNICAL FIELD

One aspect of this disclosure includes a fuel rail assembly for gasoline direct injection fuel delivery to an engine.

BACKGROUND ART

To deliver fuel to direct injection internal combustion engines, a fuel rail or tube is often provided. Frequently, the main fuel is gasoline. Current high pressure fuel rail assemblies are made of a stainless steel tube and numerous stainless steel components such as injectors that are tack welded and thermally brazed together into a complete assembly. Current rail operating pressures are around 20 MPa (2900 PSI) maximum. Conventional designs have some difficulty in dealing with a higher maximum pressure of approximately 30 MPa (4400 PSI) and beyond. Such pressures raise concerns as to the integrity and reliability of the brazed joint connection.

One of the concerns on any welded or brazed joint is the inability to easily verify the reliability of the connection. A brazed joint can visually look satisfactory but be compromised due to variations in the braze process. At higher pressures this would raise concerns about rail safety and performance.

Japanese patent Laid-Open No. 2005-69023 for example discloses a tube or rail along which fuel travels under pressure. Through holes are defined in a wall section of the tube. The fuel rail is formed of diverging branch pipes. As with other prior art disclosures, metal fittings are connected to the tube by a brazing step after the metal fittings are inserted into through holes provided in a peripheral wall section of the main rail.

When the fuel rail and fuel injectors are subjected to high pressures in direct injection gasoline engines, for example, there is sometimes a tendency for fuel to leak, especially if a positional accuracy and roughness sealing surfaces are suboptimal. See, e.g., Japanese patent Laid-Open No. 2003-129920. If the fuel rail is assembled by brazing, there may be adverse consequences to dimensional accuracy and predictability adjacent to a fuel injector holder. If tolerances are exceeded, fuel leakage problem may occur. In some situations, it may be difficult to correct out-of-tolerance circumstances because the wall thickness of the rail is prohibitively thick. Additionally, remedial measures may weaken a seal since the brazing filler metal may accumulate at the junction between a seal ring and the injector holder. Surface roughness of a sealing surface may thereby be caused.

Fuel rails made of aluminum for direct-injection internal combustion engines cannot be used where injection pressures may reach 150-250 MPa. This is because the strength of aluminum is low. Further, the fuel rail may have disadvantageous layout characteristics because the wall thickness of the rail must be sufficient to withstand high fuel pressures. Consequently, production costs rise because contact surfaces with fuel must be treated by expensive surface treatment protocols. This may be required if the aluminum fuel rail is sensitive to alcohol and corrosive fuel.

Among the art considered before filing this patent application are: U.S. Pat. Nos. 8,596,246; 8,844,500; 8,844,502; 8,074,624; EP 2284385; and EP 2333302.

SUMMARY

One aspect of this disclosure involves gasoline direct injection fuel delivery systems in which screw threads are provided on the components to be assembled. This allows for process control that will ensure a reliable connection that can withstand increased pressure and performance requirements. As described further below, one departure from conventional approaches and structures includes the method of attachment of injectors to the tube. A brazing step is no longer used. This attachment method and significantly increases allowable rail pressure and structural reliability while decreasing rail cost.

In one form, the present disclosure relates to a fuel rail (a delivery pipe) for supplying high pressure fuel from fuel booster pumps. Fuel is injected through a fuel injector (an injection nozzle) into an engine cylinder.

One embodiment of a fuel rail assembly for gasoline direct injection fuel delivery to an engine includes a common rail tube with internal and external walls, an upstream end and a downstream end. The tube has one or more threaded orifices extending between the internal and external walls. Injector sockets are threadingly engaged with the orifices.

Each of the injector sockets has a proximal nipple end region connected to the tube and a distal end region. Screw threads are disposed around the proximal nipple end region. At the tube and at the proximal end of the injector socket, the screw threads begin with a lead thread and thus form registered mechanical connections between the injector sockets and the tube that are adapted to withstand higher maximum pressures than those at which conventional fuel rail assemblies can operate safely.

An orientation notch is provided in the distal end region of at least some of the injector sockets. The lead thread of an injector socket is defined so that it is aligned with an associated orientation notch, which has its own lead thread. After exerting a pre-defined rotational force to the injector socket, the associated orientation notch is situated in a home position after threading engagement of the proximal nipple end regions of the one or more injector sockets by the tube. Thus, a pre-defined angular position of the injector sockets is created after torquing the injector sockets. In the pre-defined angular position, mechanical connections thereby formed seal the joints between the tube and the injector sockets.

In some embodiments, the fuel rail assembly has end threads defined in the internal wall of the tube at its the upstream and downstream ends. A fuel inlet with threads engages the upstream end thread at the upstream end of the tube. An end cap sensor boss with threads engages the downstream end thread at the downstream end of the tube.

The disclosed structure is expected to be used at higher maximum pressures equal to or in excess of approximately 35 MPa (5000 PSI) and will address concerns as to the integrity and reliability of conventional brazed joint connection.

DETAILED DESCRIPTION OF THE INVENTION

Figure 1:
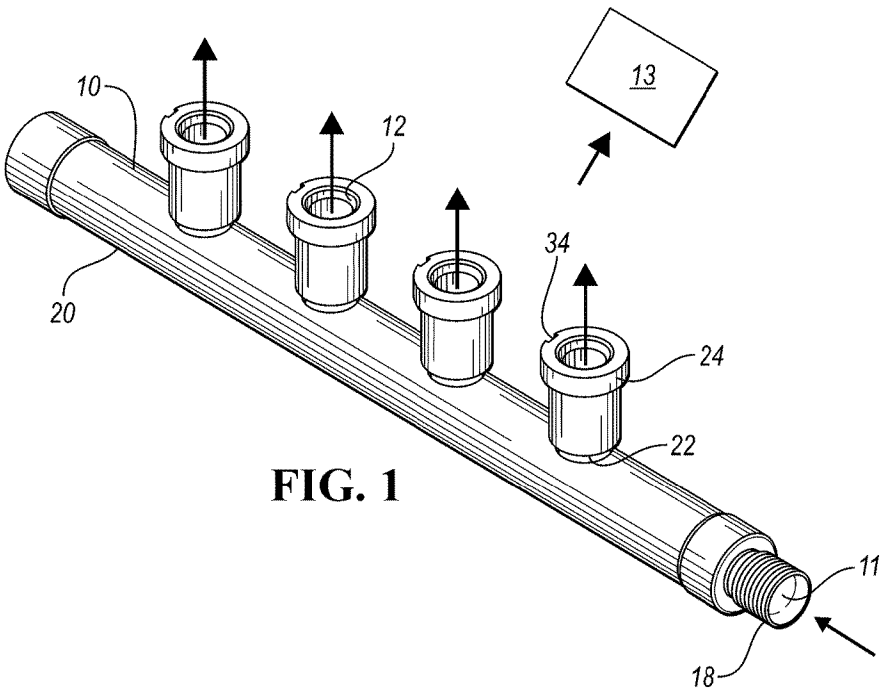
FIG. 1 is a quartering perspective view of a threaded fuel rail assembly according to one embodiment of the invention.
Figure 2:
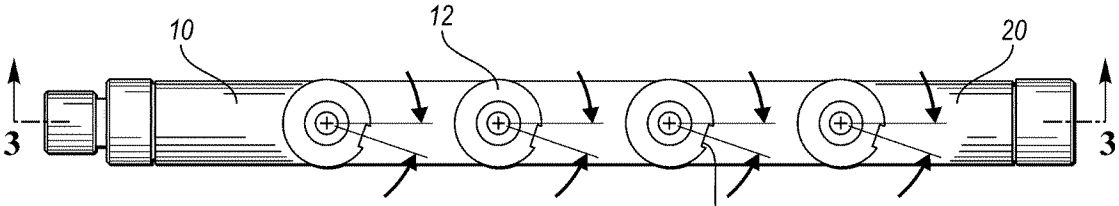
FIG. 2 is a top view thereof.
Figure 3:
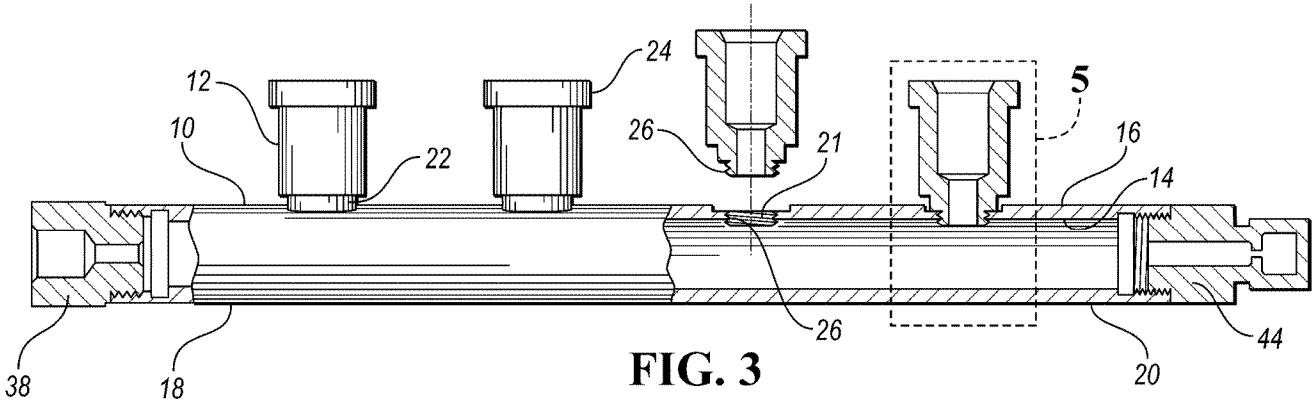
FIG. 3 is a longitudinal sectional view taken along the line 3-3 in FIG. 2.
Figure 5:
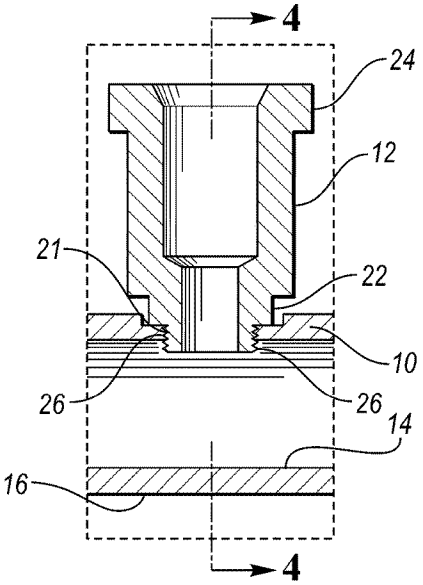
FIG. 5 is an enlargement of one representative injection socket shown in FIG. 3.
Figure 4:
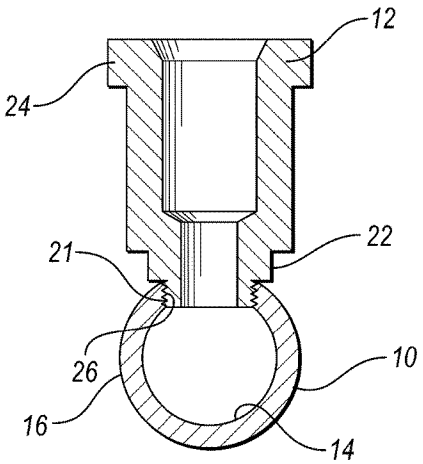
FIG. 4 is a sectional view of the fuel rail assembly taken along the line 4-4 in FIGS. 2 and 5.

One aspect of this disclosure involves gasoline direct injection fuel delivery systems that operate under pressures that may be as high as 35 MPa (5000 PSI). Preferably, precisely oriented screw threads are provided on the components to be assembled. This allows for process control that will ensure a reliable connection between a tube 10 and an injector socket 12 that can withstand the increased pressure and performance requirements (FIGS. 1-5). As described further below, one departure from conventional approaches and structures includes the method of attachment of the injectors 12 to the tube 10. A brazing step is no longer used. The disclosed attachment method allows safe and reliable operation under high rail pressures and provides structural reliability while decreasing rail cost.

In one form, the present disclosure relates to a fuel rail (a delivery pipe, 10) for supplying high-pressure fuel from fuel booster pumps through an inlet 11. Fuel is injected through a fuel injector (an injection nozzle, 12) directly into an engine cylinder 13.

One embodiment of a fuel rail assembly for gasoline direct injection fuel delivery to an engine includes a common rail tube 10 with internal 14 and external 16 walls, an upstream end 18 and a downstream end 20. The tube 10 has one or more threaded orifices 21 extending between the internal and external walls 14, 16. Injector sockets 12 are threadingly engaged with the orifices 32.

Each of the injector sockets 12 has a proximal nipple end region 22 to be connected to the tube 10 and a distal end region 24. Screw threads 26 are disposed around the proximal nipple end region 22. The screw threads 26 begin with a lead thread which mates with a lead thread 30 in an aperture 32 that extends through the tube wall, thereby forming mechanical connections between the injector sockets 12 and the tube 10 that are adapted to withstand higher maximum pressures than those at which conventional fuel rail assemblies can operate safely.

An orientation notch 34 is provided in the distal end region 24 of at least some of the injector sockets 12. On a given injector socket, the lead thread 28 is formed so that it is aligned with an associated orientation notch 34. The orientation notch 34 is oriented before engagement with the tube 10 in relation with a longitudinal axis A-A of the tube 10. After threading engagement of the proximal nipple end regions 22 of the one or more injector sockets 12 and after subjecting the injector nozzle 12 to a predefined torque, the injector sockets 12 are turned into registration with the tube 10 so that their rotational movement ends at a home or seated position (e.g. 20 degrees, FIG. 2). In that position, sealed mechanical connections are thereby formed between the tube 10 and the injector sockets 12.

In some embodiments, the fuel rail assembly has end threads defined in the internal wall at the upstream 18 and downstream ends 20 of the tube 10. A fuel inlet 38 (FIG. 3) with threads engages the upstream end thread at the upstream end 18 of the tube 10. An end cap sensor boss 44 with threads engages the downstream end thread at the downstream end 20 of the tube.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A fuel rail assembly for gasoline direct injection fuel delivery to an engine, the assembly comprising a common rail tube with a longitudinal axis, an internal and an external wall, an upstream end and a downstream end, the tube having one or more threaded orifices, the orifices having threads that have leading ends that are precisely oriented with respect to the longitudinal axis, the orifices extending between the internal and external walls; and one or more injector sockets that are adapted to mate with the threaded orifices, each injector socket having a proximal end region threadingly connected to the tube and a distal end region through which fuel is delivered to the engine;

precisely oriented screw threads disposed around the proximal end region, the screw threads including a lead thread that is received by one of the leading ends of threads of the one or more threaded orifices in the tube, thereby forming one or more registered mechanical connections between the injector sockets and the tube;

an orientation notch provided in the distal end region of at least some of the injector sockets, the lead thread of an injector socket being formed so that the lead thread is pre-positioned on an associated socket in relation to an associated orientation notch, the orientation notch being located in a prescribed angular position relation to the longitudinal axis of the rail tube after threading engagement of the proximal end regions of the one or more injector sockets with the tube at a pre-defined angular position after the one or more injector sockets are in registration with the one or more threaded orifices in relation to the longitudinal axis of the tube so that at the prescribed position the mechanical connections thereby formed between the tube and the injector sockets are sealed.

2. The fuel rail assembly of claim 1, further comprising end threads defined in the internal wall at the upstream and downstream ends of the tube;

a fuel inlet with threads that engage the upstream end thread at the upstream end of the tube; and an end cap or pressure sensor boss with threads that engage the downstream end thread at the downstream end of the tube.

3. The fuel rail assembly of claim 1 wherein imaginary centers of the one or more threaded orifices are radially aligned with the longitudinal axis.

4. The fuel rail assembly of claim 1, further comprising end threads defined in the internal wall at the upstream end of the tube; and a fuel inlet with threads that engage the end thread at the upstream end of the tube.

5. The fuel rail assembly of claim 1, further comprising end threads defined in the internal wall at the downstream end of the tube; and an end cap or pressure sensor boss with threads that engage the downstream end thread at the downstream end of the tube.

6. The fuel rail assembly of claim 1, wherein the mechanical connections are able to seal the fuel at pressures up to 5000 psi.

* * * * *